US010350632B2

(12) United States Patent
Turner

(10) Patent No.: US 10,350,632 B2
(45) Date of Patent: Jul. 16, 2019

(54) APPARATUS FOR DISPENSING A MEDIUM AND METHOD FOR FRONT FILLING THE APPARATUS

(71) Applicant: Sulzer Mixpac AG, Haag (CH)

(72) Inventor: Hayden Turner, Ayer, MA (US)

(73) Assignee: SULZER MIXPAC AG, Haag (CH)

( * ) Notice: Subject to any disclaimer, the term of this patent is extended or adjusted under 35 U.S.C. 154(b) by 160 days.

(21) Appl. No.: 15/505,126

(22) PCT Filed: Aug. 20, 2015

(86) PCT No.: PCT/EP2015/069181

§ 371 (c)(1),
(2) Date: Feb. 20, 2017

(87) PCT Pub. No.: WO2016/026940

PCT Pub. Date: Feb. 25, 2016

(65) Prior Publication Data

US 2017/0225189 A1 Aug. 10, 2017

(30) Foreign Application Priority Data

Aug. 21, 2014 (EP) ..... 14181765

(51) Int. Cl.
*B05C 17/005* (2006.01)
*B05C 17/00* (2006.01)
*B65D 83/00* (2006.01)

(52) U.S. Cl.
CPC ..... *B05C 17/003* (2013.01); *B05C 17/00576* (2013.01); *B65D 83/0005* (2013.01)

(58) Field of Classification Search
CPC ..... B05C 17/003; B05C 17/00576; B05C 17/00579; B65D 83/0005; B65D 83/0011; B65D 83/0022; B65D 83/0033
See application file for complete search history.

(56) References Cited

U.S. PATENT DOCUMENTS 3,066,836 A 12/1962 Trumbull
4,139,311 A * 2/1979 Lorscheidt ..... A45D 40/02 215/341

(Continued)

FOREIGN PATENT DOCUMENTS

DE 4139744 A1 6/1993
DE 19711249 A1 9/1998

(Continued)

*Primary Examiner* — Nicolas A Arnett
(74) *Attorney, Agent, or Firm* — Global IP Counselors, LLP

(57) ABSTRACT

An apparatus for dispensing a medium includes a cartridge in which a piston is movably receivable. An outlet is arranged in an outlet face of the cartridge for conveying the medium into a storage chamber of the cartridge. The piston includes a conveying side, a drive side disposed opposite the conveying side and at least one seal arranged at a side wall of the piston for providing a fluid-tight sealing between the piston and an inner cartridge wall. The cartridge includes a protrusion or a recess. The protrusion or the recess and the piston are arranged such that they can engage in such a way that, when the piston is arranged in a filling position, substantially no gas can be trapped between the outlet face, the conveying side of the piston and the seal facing the outlet face.

20 Claims, 3 Drawing Sheets

(56) References Cited

U.S. PATENT DOCUMENTS 4,951,848 A * 8/1990 Keller ..... B05C 17/00579 222/386
5,000,355 A * 3/1991 Pritchard ..... B05B 11/3032 222/256
5,088,630 A * 2/1992 Arch ..... B05C 17/00516 222/326
5,139,178 A * 8/1992 Arch ..... B05C 17/00516 222/326
5,301,839 A * 4/1994 Eierle ..... B05C 17/00576 222/105
5,316,186 A * 5/1994 Prestele ..... B65D 83/0005 222/327
5,377,689 A * 1/1995 Mercereau ..... B05C 17/00579 600/573
5,377,880 A * 1/1995 Moretti ..... B05B 11/0072 222/207
5,400,926 A * 3/1995 Keller ..... B05C 17/00579 222/327
5,620,423 A * 4/1997 Eykmann ..... A61M 5/31513 604/218
5,622,288 A * 4/1997 Boring ..... B05C 17/00576 222/327
5,680,967 A * 10/1997 Dang ..... B65D 83/0005 222/327
5,718,357 A 2/1998 Dang
5,878,922 A * 3/1999 Boring ..... B05C 17/00576 222/386
6,196,282 B1 * 3/2001 Mollers ..... B65B 3/04 141/113
6,439,438 B1 * 8/2002 Schouten ..... B05C 17/00533 222/1
6,443,333 B1 * 9/2002 Vanmoor ..... B05C 17/00576 222/327
6,899,254 B1 * 5/2005 Sandholm ..... B65D 83/0005 222/326
7,621,428 B2 * 11/2009 Springhorn ..... B05C 17/00576 222/326
8,678,246 B2 * 3/2014 Reuter ..... B05C 17/00579 220/745
8,925,764 B2 * 1/2015 Hiemer ..... B29C 45/4407 222/137
9,265,890 B2 * 2/2016 Chattaraj ..... A61M 5/31513
2005/0029306 A1 * 2/2005 Brennan ..... B05C 17/00576 222/327
2007/0000951 A1 * 1/2007 Springhom ..... B05C 17/00576 222/387
2007/0068593 A1 3/2007 Behar et al.
2007/0235475 A1 * 10/2007 Schneider ..... B05C 17/00576 222/325
2012/0061424 A1 3/2012 Obrist
2014/0117571 A1 * 5/2014 Howe ..... B29C 70/48 264/39
2017/0266858 A1 * 9/2017 Turner ..... B29C 45/16

FOREIGN PATENT DOCUMENTS

EP 2428282 A1 3/2012
FR 2855505 A1 12/2004
WO 2004014476 A1 2/2004

* cited by examiner

APPARATUS FOR DISPENSING A MEDIUM AND METHOD FOR FRONT FILLING THE APPARATUS

CROSS-REFERENCE TO RELATED APPLICATIONS

This application is a U.S. National Stage application of International Application No. PCT/EP2015/069181, filed Aug. 20, 2015, which claims priority to EP Application No. 14181765.0, filed Aug. 21, 2014 the contents of each of which are hereby incorporated herein by reference.

BACKGROUND

Field of Invention

The present invention is related to an apparatus for dispensing a medium and a method for front filling the apparatus acc.

Background Information

It is known in the art to fill cartridges with a medium by either front filling the cartridge through the outlet for dispensing the medium. Alternatively, cartridges are often filled through an inlet arranged on a filling side, which is usually arranged at an end of the cartridge that is arranged opposite of the outlet of the cartridge; this is usually called back filling.

It is further known in the art, as e.g. disclosed in EP 2 428 282 A1, that air can be trapped in the cartridge before or during the filling process. The trapped air can be detrimental inter alia to the dispensing quality and accuracy. Hence, a venting mechanism is often arranged in the piston to remove the trapped air after the filling process.

Although the known solutions for venting trapped air work reliably and effectively, these solutions are sometimes either too costly for certain, cost-critical applications. Furthermore, the presence of the venting mechanism sometimes provides a residual volume for air to be trapped, which cannot be removed after the filling.

To prevent air from being trapped in the cartridge during the filling process, it is also know in the art to apply a vacuum to the cartridge and subsequently fill the cartridge with the medium. This has the disadvantage of making the filling process more cumbersome and costly.

Further prior art cartridges are known from FR 2 855 505 A1; DE 41 39 744 A1; U.S. Pat. Nos. 5,718,357; 3,066,836; WO 2004/014476; and DE 197 11 249 A1.

SUMMARY

It is thus an object of the present invention to overcome the above-mentioned drawbacks, i.e. to provide an apparatus for dispensing the medium and a method for front filling the apparatus that allow for the minimization of the amount of gas that is trapped in the cartridge before and during the filling process, which can be safely and reliably operated and which are cost efficient.

These objects are met by the apparatus for dispensing the medium and the method for front filling the apparatus as described herein.

Additional advantageous embodiments of the present invention are also described herein.

The apparatus for dispensing a medium according to the present invention comprises a cartridge in which a piston is movably receivable. An outlet is arranged in an outlet face of the cartridge for conveying the medium into a storage chamber of the cartridge, with the outlet face preferably being disposed at an end of the cartridge; alternatively or in addition the outlet is suitable for dispensing the medium from the storage chamber. The piston comprises a conveying side, a drive side disposed opposite the conveying side and at least one seal arranged at a side wall of the piston for providing a fluid-tight sealing between the piston and an inner cartridge wall. In particular, the seal is a lip seal. The cartridge, preferably the outlet face of the cartridge, comprises at least one protrusion and/or at least one recess, in particular disposed adjacent to the outlet. The protrusion or the recess and the piston are arranged such that they can engage in such a way that, when the piston is arranged in a filling position, substantially no gas, in particular air, can be trapped between the outlet face, the conveying side of the piston and the side of the seal facing the outlet face.

This has the advantage that, when the piston is in the filling position, substantially no gas, in particular air, can be trapped between the outlet face, the conveying side and the seal due to the arrangement of the corresponding protrusion and/or recess. This achieves a matching of the corresponding shapes of the outlet face, conveying side and seal that are substantially in contact when the piston is in the filling position. This has the further advantageous effect that no additional venting mechanism is necessary, which makes the production of the piston more cost effective and the operation safer and more reliable.

In the context of the present invention, the term that "substantially no gas can be trapped" has the meaning that apart from production tolerances, substantially no residual volume remains for the gas between the outlet face, conveying side and seal when the piston is in the filling position.

The filling position is considered to be the position of the piston in the context of the present invention when the piston is moved as far as possible at intended use towards the outlet face.

In the context of the present invention, the term "conveying side" has the meaning of the side of the piston that is in contact with the medium at intended use; the term "drive side" has the meaning of the side of the piston at which force is applied to move the piston towards the outlet face and to dispense the medium.

Disposing the outlet face at an end of the cartridge means that this can be filled or emptied in a very quick and efficient manner.

Preferably the outlet face has an outlet face surface facing the conveying side of the piston, with the outlet face surface being at least substantially planar in a region between the outlet and the least one protrusion and/or in a region between the outlet and the at least one recess.

Advantageously a conveying side surface of the conveying side is at least substantially planar in a region facing the region of the outlet face surface that is at least substantially planar.

Providing a substantially planar outlet face surface and/or conveying side surface render the tools used in an injection molding process to form a cartridge and/or piston significantly more simple as no undercuts etc. have to be provided in these components. This significantly reduces the cost of manufacture of such components.

Preferably the cartridge and the outlet face are integrally formed. Integrally formed in this context means that the cartridge and the outlet face are either made in one piece in one and the same tool or the two parts are produced separately e.g. from the same material and are then connected to one another e.g. by bonding, welding or melting to one another, so that an integral connection, i.e. a non releasable connection is formed between the two components.

Preferably, the lip seal is arranged circumferentially at the side wall. In a preferred embodiment, the cartridge is formed substantially as a hollow cylinder at least in the section of the cartridge in which the piston is movably receivable.

In a preferred embodiment, the residual volume between the outlet face, the front face and the side of the seal facing the outlet face is substantially filled by the protrusion when the piston is arranged in the filling position at intended use.

In a preferred embodiment, the at least one seal can engage the at least one recess such that substantially no gas can be trapped in the recess when the piston is arranged in the filling position at intended use.

In a preferred embodiment the piston comprises no venting mechanism for trapped gas.

In a preferred embodiment, the piston can be positioned in the filling position with a force sufficient to overcome frictional forces when moving the piston in the cartridge. With other words, it is not necessary to apply e.g. a force that is compressing and/or deforming the piston in the filling position in such a way that substantially no gas can be trapped between the outlet face, the front face and the seal facing the outlet face.

This has the advantage that the piston can be moved to the filling position in a safe and reliable manner without the requirement of applying a strong force.

In a preferred embodiment, at least the section of the piston facing towards the outlet face, preferably the whole piston, is substantially rigid. With other words, the piston is substantially not elastically reversible compressible at intended use.

This has the advantage to allow for a higher accuracy and reliability of the dispensing process and also of the filling of the cartridge, since the piston is substantially not expanding after the application of the force for filling or dispensing is stopped.

In a preferred embodiment, the protrusion is arranged on the outlet face and is substantially facing away from the outlet face, such that the protrusion can engage a piston-recess formed between the side wall and the seal.

Usually, a lip seal is used to provide a fluid-tight sealing between the piston and the inner cartridge wall; to ensure the fluid-tight sealing, such a lip seal has a certain flexibility of movement to be deflected; to allow for such flexibility, a piston-recess is formed between the side of the lip seal facing the outlet face and the side wall of the piston. The protrusion arranged on the outlet face can reliably engage the piston-recess. Such a protrusion is producible in a cost efficient manner. Often, the protrusion can be formed as a ring or ridge engaging a ring-like piston-recess of the cylinder-like piston.

In a preferred embodiment, the cartridge and the at least one protrusion are formed in one piece. This has the advantage of reducing the production costs.

In a preferred embodiment, the protrusion is in at least a section tapered in direction away from outlet face in at least one cross-sectional view along the longitudinal axis of the cartridge. Preferably the protrusion tapers from the outlet face away from the inner cartridge wall towards the longitudinal axis of the cartridge. Such a design makes the molding tool of the cartridge and/or outlet face simpler to manufacture reducing the cost of production of such cartridges.

Preferably the recess of the cartridge tapers from the outlet face towards the inner cartridge wall when viewed along the longitudinal axis of the cartridge.

It is preferred if the at least one protrusion and/or the at least one recess is a continuous recess extending around a periphery of the outlet face. Providing a continuous protrusion or a continuous recess that is preferably formed from one piece means that these can be produced in a simple fashion in a molding tool. Moreover, a corresponding recess, cut-out can then be provided in a simple manner at the piston to engage the outlet face of the cartridge.

If a circular cartridge is used then the at least one protrusion and/or the at least one recess of the cartridge is/are of circular design when viewed in the longitudinal direction of the cartridge.

In a preferred embodiment, the cartridge comprises an insert end with an insert opening for inserting the piston into and/or removing the piston from the cartridge. When the piston is in the filling position, the drive side of the piston faces the insert end.

In a preferred embodiment, the cartridge comprises blocking means or element for preventing the movement of the piston past the blocking element towards the insert opening. In particular, the blocking element are formed in one piece with the cartridge.

This has the advantage that during the filling of the cartridge the piston cannot accidentally be pushed out of the cartridge at the insert end, which makes the filling operation more reliable. Furthermore, when the piston is pushed against the blocking element by the conveyance of the medium into the cartridge, the the pressure in the medium will increase, which can be detected to stop the filling process.

In a preferred embodiment, the blocking element are formed such that the piston is movable past the blocking element towards the outlet face. This allows advantageously for the insertion of the piston after the blocking element are arranged in the cartridge, e.g. after producing the cartridge and the blocking element in an injection molding process.

In a preferred embodiment, the cartridge, preferably the protrusion and optionally the blocking mean are produced with an injection molding process. This has the advantage of making available a cartridge that is producible in a cost-efficient manner.

In a preferred embodiment, the piston and the at least one seal are formed in one piece, preferably by injection molding. This has the advantage of making available a piston with a seal that is producible in a cost-efficient manner and that is reliable to use In a preferred embodiment, at least one further seal is arranged on the side wall on the side of the seal facing away from outlet face. This allows for an improved sealing of the piston in the cartridge.

A further aspect of the present invention relates to a method for front filling an apparatus with a medium. In particular, an apparatus as described above is used in the method. The method comprises the following steps:

Providing the apparatus that comprises a cartridge in which a piston is movably receivable. An outlet is arranged in an outlet face of the cartridge for conveying the medium into a storage chamber of the cartridge; alternatively or in addition the outlet is suitable for dispensing the medium from the storage chamber. The piston comprises a conveying side, a drive side disposed opposite the conveying side and at least one seal arranged at a side wall for providing a fluid-tight sealing between the piston and an inner cartridge wall.

The cartridge comprises at least one protrusion or at least one recess, wherein the piston is arranged in a filling position and the protrusion or the recess and the piston are arranged such that they engage in such a way that substantially no gas is trapped between the outlet face, a front face of the piston and the seal facing the outlet face;

Conveying the medium into the cartridge through the outlet;

Moving the piston away from the outlet face with the medium conveyed into the cartridge until the required amount of medium was conveyed into the cartridge and/or optionally the piston is positioned at blocking element of the cartridge.

The conveyance of the medium into the cartridge is usually performed by applying a counter pressure on the piston on the drive side to fill the cartridge in a controlled and reliable manner.

Typical cartridge sizes are for example between 2.5 ml to 1500 ml. Since the more air can be entrapped the larger the cartridge is the invention is in particular advantageous with cartridge volumes of 100 ml and larger.

Preferably, the cartridge is filled with substances, in particular with impression materials, adhesives, bonding materials, materials for chemical anchorings or protective coatings materials.

The media to be dispensed are typically used as impression materials, e.g. on the formation of dental impressions, as a cement material for prosthetic restorations, as a temporary cement for trial cementing restorations or for cementing temporary crowns. Further applications are in the building industry where they are e.g. used as a replacement for mechanical joints that corrode over time. Adhesive bonding can be used to bond products such as windows and concrete elements. The use of protective coatings, for example moisture barriers, corrosion protection and anti-slip coatings, is also becoming increasingly common. Examples of flowable media which can be used are, for example, distributed by the company Coltene using the tradename AFFINIS® or by the company DMG using the tradename PermaCem.

BRIEF DESCRIPTION OF THE DRAWINGS

Referring now to the attached drawings which form a part of this original disclosure.

DETAILED DESCRIPTION OF THE EMBODIMENTS

Figure 1:
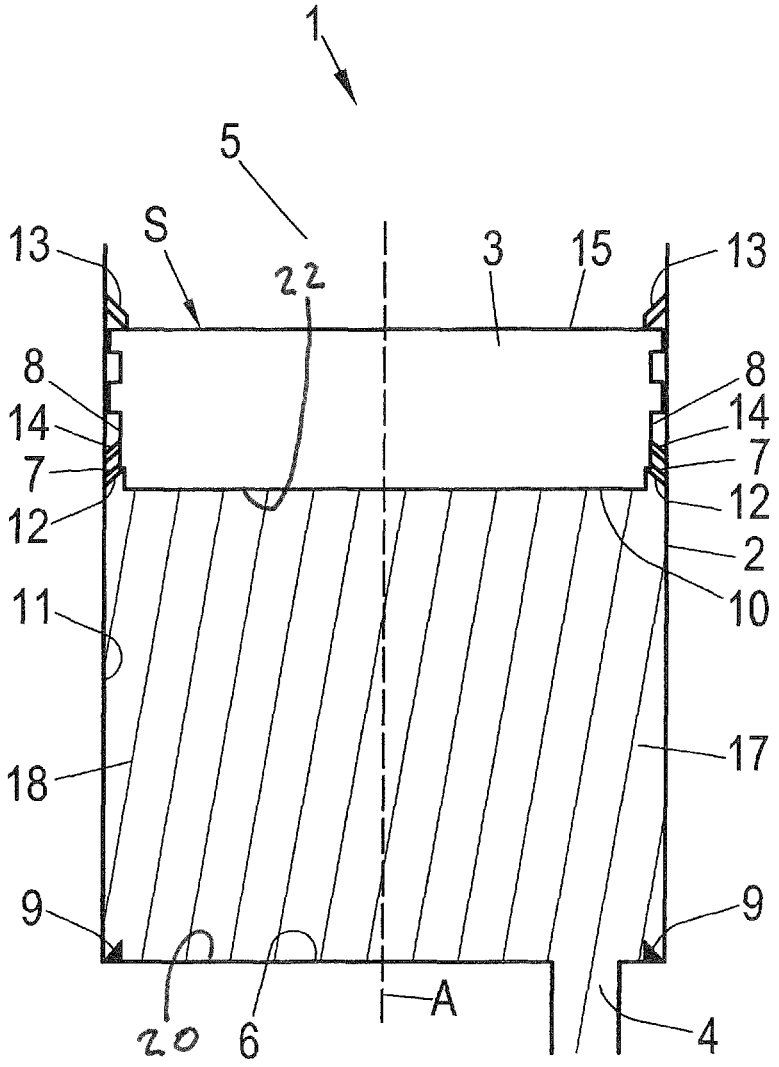
FIG. 1 is a schematic view of an apparatus for dispensing a medium according to the present invention with a piston in a filled position.

FIG. 1 shows an apparatus 1 for dispensing a medium 18. The apparatus 1 comprises a cartridge 2, in which a piston 3 is arranged. The piston 3 is movable substantially along a longitudinal axis A of the cartridge 2. The cartridge 2 is formed cylinder-like at least in the section in which the piston 3 is movably receivable.

The cartridge 2 has an insert opening 5 for inserting the piston 3 into the cartridge. A blocking means (or element) 13 is arranged in the cartridge 2 at an inner cartridge wall 11 such that the piston can be inserted into the cartridge 2 and moved past the blocking element 13 towards an outlet face 6 of the cartridge 2. For this, the blocking element 13 is formed such that it is (they are) flexible and e.g. formed as a, in particular, circumferential lip, which is tilted towards the outlet face 6. Due to this arrangement, the movement of the piston 3 past the blocking element 13 towards the insert opening 5 can be prevented at intended use.

The cartridge 2 and the outlet face 6 are integrally formed at an end of the cartridge, with the outlet face 6 being disposed and formed at least substantially perpendicular to the inner cartridge wall 11.

A protrusion 9 is arranged on the outlet face 6 of the cartridge 2. The protrusion is arranged in a circumferential manner and faces away from the outlet face 6 and is tapered in a direction away from outlet face 6 along the longitudinal axis A of the cartridge 2.

The cartridge 2 has a storage chamber 17 for receiving the medium 18 to be dispensed. The size of the storage chamber 17 depends on the position of the piston 3. The shaded area is filled with medium 18.

The piston 3 has a drive side 15 and a conveying side 10. For dispensing the medium, a pressure is applied to the drive side 15 either in a manual or motorized manner. The piston 3 further has a seal 7, which is formed as a lip seal; the lip can be deflected in a flexible manner to ensure a fluid-tight sealing. The seal 7 is arranged at a side wall 8 of the piston in a circumferential manner for providing a fluid-tight sealing between the piston 3 and the inner cartridge wall 11, such that no medium can pass along the side wall 8 of the piston 3 from the conveying side 10 to the drive side 15.

The piston 3 has a piston-recess 12 formed between the side wall 8 and the seal 7. For an improved sealing, the piston 3 has a further seal 14, which is also formed as a lip seal.

According to FIG. 1, the piston 3 is arranged in the filled position S, which represents the position of the piston 3 farthest away from the outlet face 6. Hence, the size of the storage chamber 17 is maximized for receiving the medium 18.

When a force is applied to the piston 3 in a direction towards the outlet face 6, medium 18 is dispensed from the cartridge 2 through an outlet 4 arranged in the outlet face 6. The dispensing process can continue until the piston 3 comes into contact with the outlet face 6.

As also shown in FIG. 1 the outlet face 6 has an outlet face surface 20 facing a conveying side surface 22 of the conveying side 10 of the piston. The outlet face surface 20 is at least substantially planar in a region between the outlet 4 and the protrusion 9. Likewise the conveying side surface 22 of the piston is at least substantially planar in a region facing the at least substantially planar outlet face surface 20.

Figure 2:
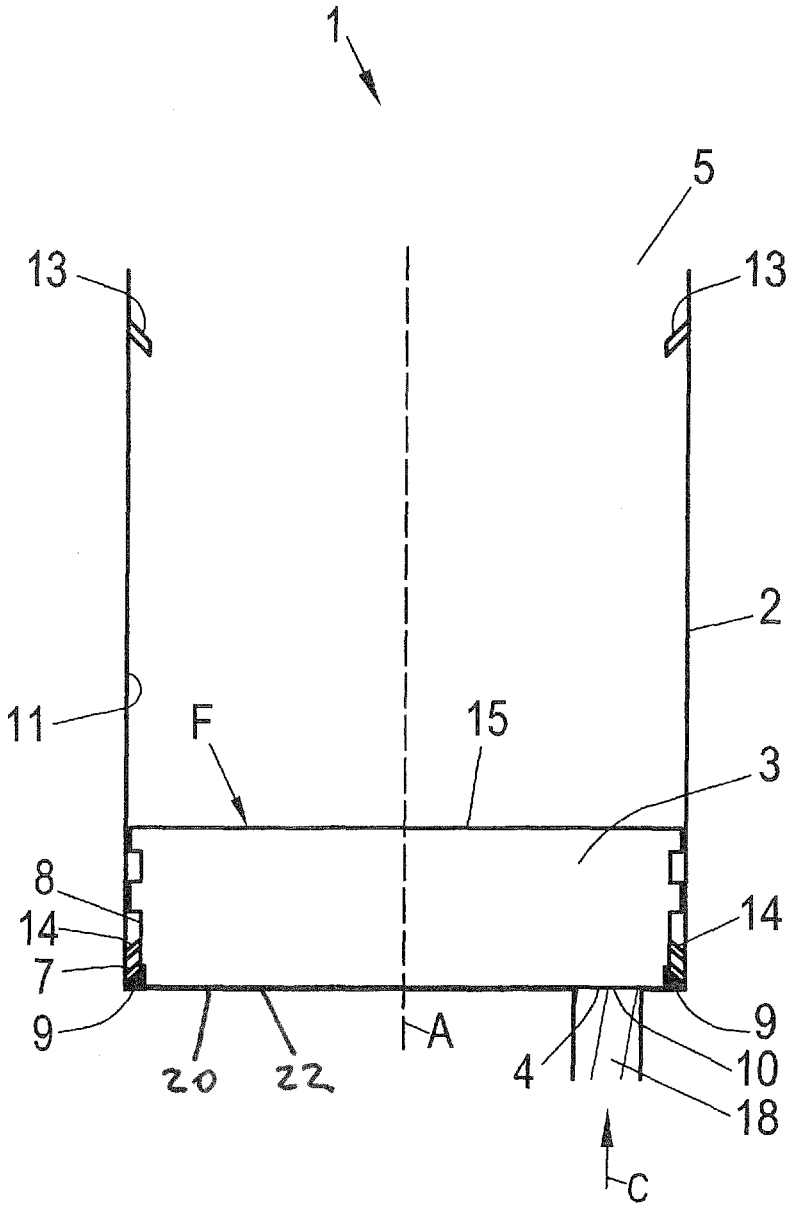
FIG. 2 is a schematic view of an apparatus according to FIG. 1 with the piston in a filling position.

The protrusion 9 tapers from the outlet face 6 away from the inner cartridge wall 11 towards the longituindal axis A, when viewed along the longitudinal axis A of the cartridge. FIG. 2 shows the apparatus 1 for dispensing the medium according to FIG. 1 in a filling position F of the piston 3.

Parts denominated with the same reference numeral relate to the same feature in all the figures and are only explained again when needed.

The apparatus 1 according to FIG. 2 represents the arrangement of the piston 3 before the filling of the cartridge 2. After the filling, the position of the piston 3 is as shown in FIG. 1.

Before the start of the filling process, the piston 3 is arranged in the filling position F. The protrusion 9 engages the piston-recess 12 formed between the side wall 8 and the seal 7. The protrusion 9 is formed such that substantially no air is trapped between the outlet face 6, the conveying side 10 of the piston 3 and the side of the seal 7 facing the outlet face 6.

For the filling process, medium 18 is conveyed into the cartridge 2 and a force is applied to the drive side 15 of the piston 3, such that the piston 3 is pushed back towards the blocking element 13 by the medium 18 conveyed into the cartridge in a controlled manner.

The medium 18 is conveyed into the cartridge 2 through outlet 4 in the conveying direction C.

Due to the fact that substantially no residual volume for air to be trapped remains in the filling position F between the outlet face 6, the conveying side 10 of the piston 3 and the side of the seal 7 facing the outlet face 6, it is possible to omit the arrangement of a venting mechanism on and/or in the piston 3. Furthermore, it is also not necessary to apply a vacuum to the cartridge 2 before the filling process.

The piston 3 with the seal 7 and further seal 14 are formed in one piece. The cartridge 2 with the protrusion 9 is also formed in one piece. Both the piston 3 and the cartridge 2 are produce by injection molding. The cartridge 2 and piston 3 are made from a plastic material.

Figure 3:
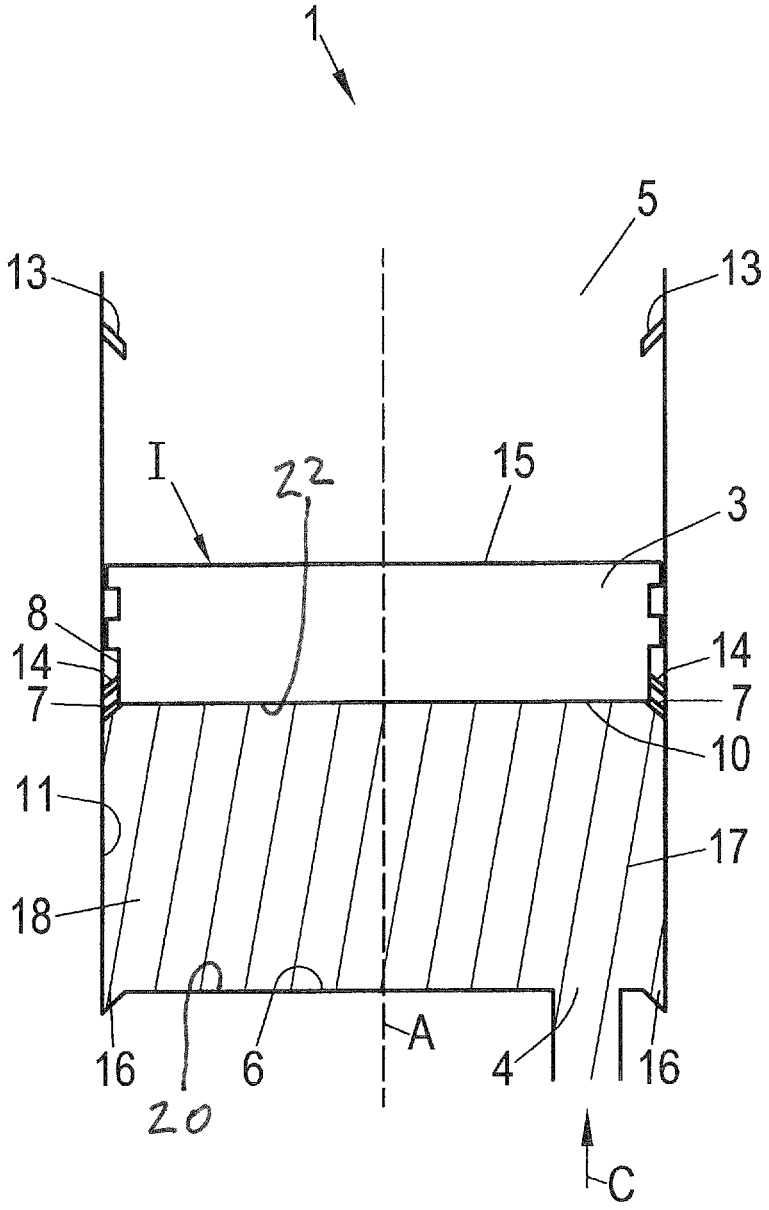
FIG. 3 is a schematic overview of an apparatus for dispensing a medium according to an alternative embodiment of the present invention with a piston in an intermediate position.

FIG. 3 shows an alternative embodiment of an apparatus 1 according to the invention in a schematic view.

The piston 3 is at an intermediate position I between a filling position and a filled position.

The piston 3 has a lip seal 7 that is positioned at the side wall 8 in a different manner compared to FIGS. 1 and 2.

To accommodate the lip seal according to FIG. 3, the cartridge has a recess 16, which is arranged in a circumferential manner. In the filling position, the seal 7 and the recess 16 can engage such that no air is trapped between the outlet face 6, the conveying side 10 of the piston 3 and the side of the seal 7 facing the outlet face 6.

The recess 16 tapers from the outlet face 6 towards the inner cartridge wall 11 when viewed along the longitudinal axis A of the cartridge.

The outlet face surface 20 of the piston 3 of FIG. 3 is at least substantially planar in a region between the outlet 4 and recess 16. The conveying side surface 22 of the piston 3 is planar in a region facing the planar outlet face surface 20.

The invention claimed is:

1. An apparatus for dispensing a medium comprising:

a piston; and a cartridge configured to movably receive the piston, and including an outlet arranged in an outlet face of the cartridge, the outlet configured to convey the medium into a storage chamber of the cartridge or configured to dispense the medium from the storage chamber, the outlet face being disposed at an end of the cartridge, the piston comprising a conveying side, a drive side disposed opposite the conveying side, and at least one seal arranged at a side wall of the piston, and a recess formed between the side wall and the seal, and configured to provide a fluid-tight seal between the piston and an inner cartridge wall, the cartridge comprising at least one protrusion disposed adjacent to the outlet on the outlet face, substantially facing away from the outlet face and spaced apart from the outlet, such that the protrusion is capable of engaging the recess in the piston, the protrusion and the piston being arranged so as to engage such that, when the piston is arranged in a filling position, substantially no gas is trapped between the outlet face, the conveying side of the piston and the seal facing the outlet face.

2. The apparatus according to claim 1, wherein the outlet face has an outlet face surface facing the conveying side of the piston, the outlet face surface being at least substantially planar in a region between the outlet and the least one protrusion or in a region between the outlet and the at least one recess.

3. The apparatus according to claim 2, wherein a conveying side surface of the conveying side is at least substantially planar in a region facing the region of the outlet face surface that is at least substantially planar.

4. The apparatus according to claim 1, wherein the cartridge and the outlet face are integrally formed.

5. The apparatus according to claim 1, wherein a residual volume between the outlet face, the conveying side and the seal facing the outlet face is substantially filled by the protrusion, when the piston is arranged in the filling position at intended use.

6. The apparatus according to claim 1, wherein the at least one seal is configured to engage the at least one protrusion such that substantially no gas is capable of being trapped in the recess when the piston is arranged in the filling position at intended use.

7. The apparatus according to claim 1, wherein the piston is capable of being positioned in the filling position with a force sufficient to overcome frictional forces when moving the piston in the cartridge.

8. The apparatus according to claim 1, wherein the piston comprises no venting mechanism for the trapped gas.

9. The apparatus according to claim 1, wherein at least the section of the piston facing towards the outlet face is substantially rigid.

10. The apparatus according to claim 1, wherein the cartridge and the at least one protrusion are formed in one piece.

11. The apparatus according to claim 1, wherein the protrusion is in at least a section tapered in direction away from outlet face in at least one cross-sectional view along a longitudinal axis of the cartridge.

12. The apparatus according to claim 1, wherein the protrusion tapers from the outlet face away from the inner cartridge wall towards a longitudinal axis, when viewed along the longitudinal axis A of the cartridge.

13. The apparatus according to claim 1, wherein the at least one protrusion at least one continuous protrusion extending around a periphery of the outlet face.

14. The apparatus according to claim 1, wherein the cartridge comprises an insert end with an insert opening for inserting the piston into and removing the piston from the cartridge.

15. The apparatus according to claim 14, wherein the cartridge comprises a blocking element configured to prevent movement of the piston past the blocking element towards the insert opening.

16. The apparatus according to claim 15, wherein the blocking element is formed such that the piston is capable of being moved past the blocking element towards the outlet face.

17. The apparatus according to claim 15, wherein the cartridge is produced with an injection molding process.

18. The apparatus according to claim 1, wherein the piston and the at least one seal are formed in one piece.

19. The apparatus according to claim 1, wherein the cartridge is filled with substances selected from impression materials, adhesives, bonding materials, materials for chemical anchorings or protective coatings materials.

20. A method for front filling an apparatus, with a medium, comprising:

providing the apparatus comprising a cartridge configured to movably receive a piston, and including an outlet arranged in an outlet face of the cartridge, the outlet configured to convey the medium into a storage chamber of the cartridge or configured to dispense the medium from the storage chamber, the piston comprising a conveying side, a drive side disposed opposite the conveying side and at least one seal arranged at a side wall, and a recess formed between the side wall and the seal, and configured to provide a fluid-tight seal between the piston and an inner cartridge wall, the cartridge comprising at least one protrusion on the outlet face, substantially facing away from the outlet face and spaced apart from the outlet, such that the protrusion is capable of engaging the recess in the piston, the piston being arranged in a filling position and the protrusion or the recess and the piston being arranged so as to engage such that substantially no gas is trapped between the outlet face, a front face of the piston and the seal facing the outlet face;

conveying the medium into the cartridge through the outlet;

moving the piston away from the outlet face with the medium conveyed into the cartridge until at least one of a predetermined amount of medium is conveyed and the piston is positioned at a blocking element of the cartridge.

* * * * *